US006811579B1

(12) United States Patent
von Dungen et al.

(10) Patent No.: US 6,811,579 B1
(45) Date of Patent: Nov. 2, 2004

(54) ABRASIVE TOOLS WITH PRECISELY CONTROLLED ABRASIVE ARRAY AND METHOD OF FABRICATION

(75) Inventors: Jurgen von Dungen, Burstadt (DE); York Falkenberg, Rodermark (DE); Dirk Heinemann, Homburg (DE)

(73) Assignee: Diamond Innovations, Inc., Worthington, OH (US)

( * ) Notice: Subject to any disclaimer, the term of this patent is extended or adjusted under 35 U.S.C. 154(b) by 322 days.

(21) Appl. No.: 10/172,034

(22) Filed: Jun. 14, 2002

(51) Int. Cl.[7] ..... B24D 18/00; B24D 3/06

(52) U.S. Cl. ..... 51/293; 51/307; 51/308; 51/298; 51/295

(58) Field of Search ..... 51/298, 307, 308, 51/309, 292, 295

(56) References Cited

FOREIGN PATENT DOCUMENTS

| | | |
|---|---|---|
| EP | 870578 | 9/1997 |
| EP | 1208945 A1 | 5/2002 |
| JP | 09-066468 | 3/1997 |
| JP | 10-329030 | 12/1998 |

OTHER PUBLICATIONS

G. Brukhard, B. Zigerling and M. Boretius, "Cutting With Definitely Designed Diamond or cBN–grains", #49 6103 892274. (Article and Translation) (no date).

*Primary Examiner*—Michael Marcheschi
(74) *Attorney, Agent, or Firm*—Pepper Hamilton LLP

(57) ABSTRACT

A method for fabricating an abrasive tool having a work surface commences by applying an electrically non-conductive layer the work surface of the abrasive tool. A pattern is etched in the work surface preferably using a laser beam. Metal and abrasive particles are electroplated or electroless plated onto the work surface pattern. The non-conductive layer is removed from the work surface. Alternatively, an adhesive can be applied as a layer on the work surface. A negative pattern then is etched in the adhesive layer, i.e., the adhesive where no abrasive is desired is etched away. Abrasive particles then can contact the work surface to be adhered thereon to the remaining adhesive. Metal again can be electroplated or electrolessly plated onto the work surface. By multiple repetitions of both methods, different sizes and types of abrasive particles in different concentrations may be applied to different areas of the work surface.

26 Claims, 4 Drawing Sheets

ABRASIVE TOOLS WITH PRECISELY CONTROLLED ABRASIVE ARRAY AND METHOD OF FABRICATION

CROSS-REFERENCE TO RELATED APPLICATIONS

None

STATEMENT REGARDING FEDERALLY SPONSORED RESEARCH

Not applicable.

BACKGROUND OF THE INVENTION

The present invention generally relates to abrasive grinding tools and more particularly to grinding tools having a precisely controlled array or pattern of abrasive particles thereon.

Heretofore, abrasive particles were applied to the exterior surfaces of or embedded in grinding elements by a variety of techniques. Regardless of the technique, a random distribution of abrasive particles characterized the cutting edge of the grinding tool. This can be seen by reference to FIG. 1, which is a photomicrograph at 100 × magnification of 40/50 mesh abrasive particles nickel-plated onto a steel core grinding wheel. FIG. 2 is the same wheel at 50 ×magnification it will be seen that the abrasive was nickel plated in a random distribution and at an abrasive concentration that could not be controlled at any given area of the abrasive tool. This means that there is a risk is wheel loading. Moreover, there is little opportunity to adjust abrasive size, type, and geometry of the abrasive particles at any given area of the tool. While the total amount of abrasive particles plated onto the tool can be controlled such control allows for wide latitude in process repeatability and quality control.

Heretofore, the art has achieved specific abrasive patterns on tool surfaces using adhesive foils and printing technology to create non-conductive areas to prevent deposition of Ni during the galvanic plating process. These processes are limited to planar surfaces and do not meet the industry demands to full utilize the performance of superabrasive crystals on the edges or other complex surface geometries of common grinding wheels and other tools. For example, EP 0870578 A1 proposes to hold the abrasive grains in place with an adhesive layer and then drills grooves into the abrasive crystals that protrude from the Ni layer.

Clearly, there exits a need in the art to be able to precisely control the location, concentration, grade, etc. of abrasive crystals applied to tools work surfaces. It is to such need that the present invention is directed.

BRIEF SUMMARY OF THE INVENTION

A method for fabricating an abrasive tool having a work surface commences by applying an electrically non-conductive layer on the work surface of the abrasive tool. A pattern is etched either in the work surface or the non-conductive layer preferably using a laser beam. Metal and abrasive particles are electroplated or electroless plated onto the work surface pattern. The non-conductive layer is removed from the work surface. By multiple repetitions of this method, different sizes and types of abrasive particles in different concentrations may be applied to different areas of the work surface.

Alternatively, an adhesive can be applied as a layer on the work surface of the abrasive tool. A negative pattern then is etched in the adhesive layer, i.e., the adhesive where no abrasive is desired is etched away. Abrasive partides then can contact the work surface to be adhered thereon to the remaining adhesive. Again, by multiple repetitions of this method, different sizes and types of abrasive particles in different concentrations may be applied to different areas of the work surface. Metal again can be electroplated or electrolessly plated onto the work surface.

Consonant in these two embodiments is the use of a laser or other precise removal system to determine the precise location where abrasive particles are to be adhered onto the work surface of an abrasive tool. Moreover, both embodiments are amendable to multiple repetitions and to yielding metal coated work surfaces with precisely located abrasive particles of controlled size, type, and concentration by location.

BRIEF DESCRIPTION OF THE DRAWINGS

For a fuller understanding of the nature and advantages of the present invention, reference should be had to the following detailed description taken in connection with the accompanying drawings, in which.

The drawings will be described in more detail below.

DETAILED DESCRIPTION OF THE INVENTION

Figure 1:
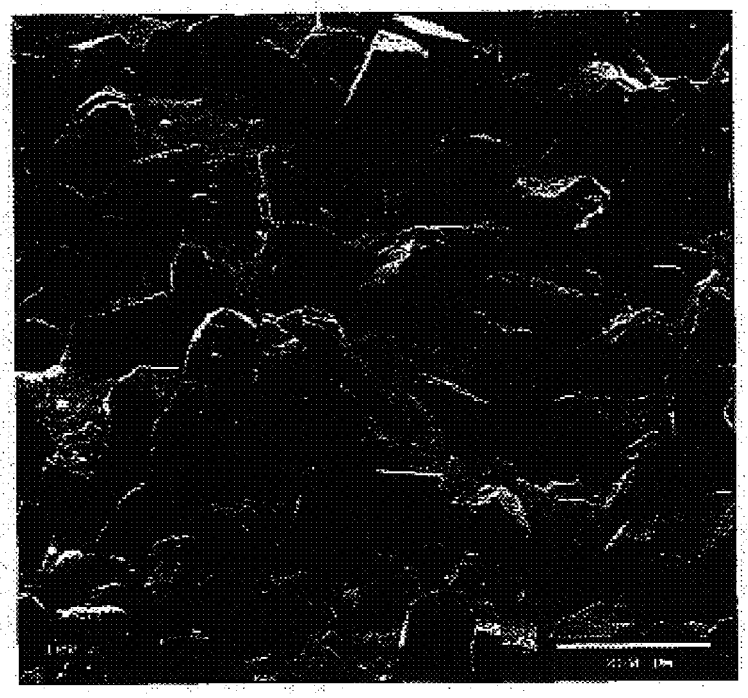
FIG. 1 PRIOR ART
FIG. 1 is a photomicrograph of at 100 × magnification of 120/140 mesh abrasive particles nickel-plated onto a steel core grinding wheel documenting the prior art in wheel manufacturing.
Figure 2:
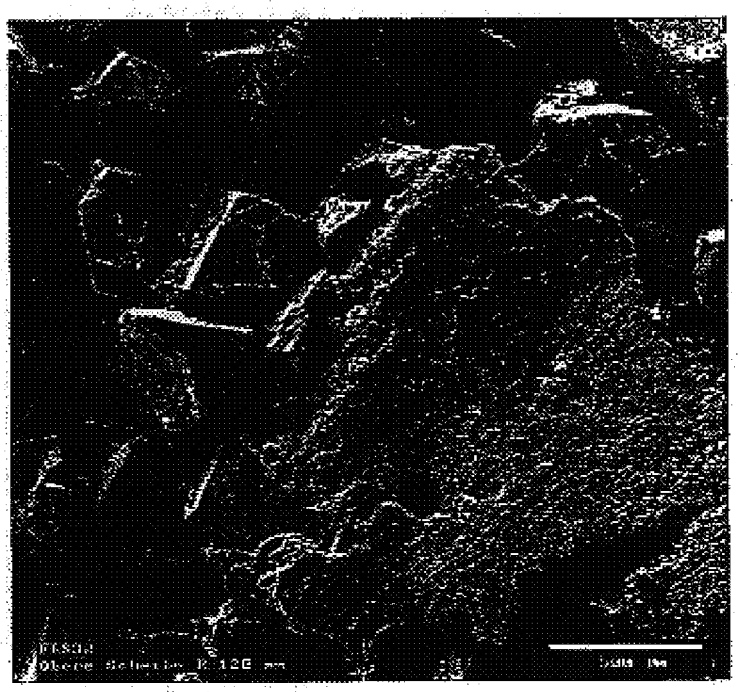
FIG. 2 PRIOR ART
FIG. 2 is a photomicrograph of at 50 × magnification of 40/50 mesh abrasive particles nickel-plated onto a steel core grinding wheel documenting the prior art in wheel manufacturing.
Figure 3:
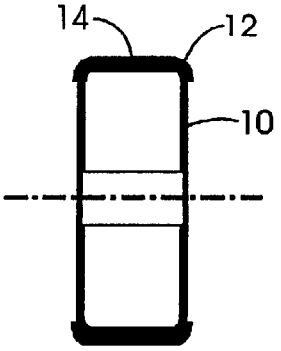
FIGS. 3–5 are simplified side elevational views of common grinding wheel shapes showing the complex geometries that require abrasive particle coating.
Figure 4:
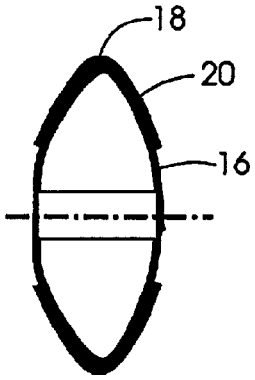
Figure 5:
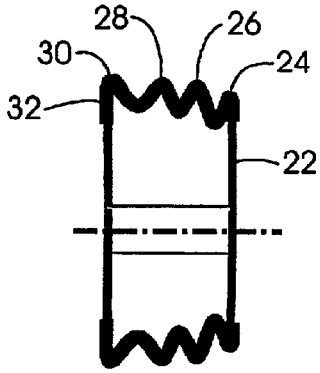

The value of the present invention can be appreciated by reference to FIGS. 3–5, which depict common grinding wheel shapes. In particular, FIG. 3 depicts a grinding wheel, 10, has radius areas, e.g., a radius area, 12, which requires an abrasive particle layer, 14 (exaggerated in thickness for illustrative purposes only), to be coated thereover. Radius 12 is difficult to coat with abrasive particles, especially is the concentration/type/size of abrasive particles over radius 12 is different that over the flat area of the periphery of wheel 10.

In FIG. 4, a wheel, 16, has a radius area, 18, which is required to be coated with an abrasive particle layer, 20. Again, the geometry of radius area 18, is difficult to coat, especially is the concentration/type/size of abrasive particles over radius 12 is different that over the flat area of the periphery of wheel 16.

In FIG. 5, a wheel, 22, has a series of ridges, 24–30, which ridges are required to be coated with an abrasive particle layer, 32. Again, the geometry of ridges 24–30 makes it difficult to effectively coat, especially is the concentration/type/size of abrasive particles over ridges 24–30 is different that over the flat area of the periphery of wheel 16 or different for each ridge.

Figure 6:
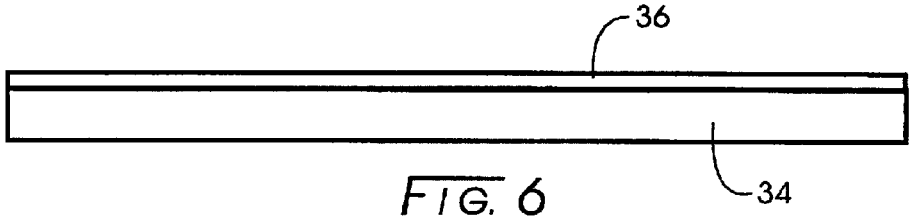
FIGS. 6–9 are schematic representations of the process steps used in fabricating abrasive tools with precisely controlled abrasive arrays of abrasives.

The present invention, then, fabricates abrasive tools with precisely controlled abrasive array by a distinctly multi-step process, which is illustrated in FIGS. 6–9. Referring initially to FIG. 6, a tool core, 34, has its work surface illustrated in simplified cross-sectional elevation view. In the initial step of the inventive process, an electrically non-conductive coating or paint, 36, is applied to the works surface of tool core 34. Any suitable coating may be used so long as it does not deleteriously affect tool core 34 or its work surface. Suitable such coatings include, inter alia, alkyds, epoxies, vinyls, acrylics, amides, urea-formaldehydes, and a wide variety of additional coatings well known to those skilled in the art. Additional general information on coatings can be found in, for example, D. H. Solomon, *The Chemistry of Organic Film Formers*, Robert E Krieger Publishing Co., Inc., Huntington, N.Y. 11743 (1977). About the only requirements of coating 36 is that is adequately adheres to tool core 34, does not adversely affect the work surface of tool core 34, is electrically non-conductive, and can withstand galvanic electroplating processing and maintain its properties.

Figure 7:
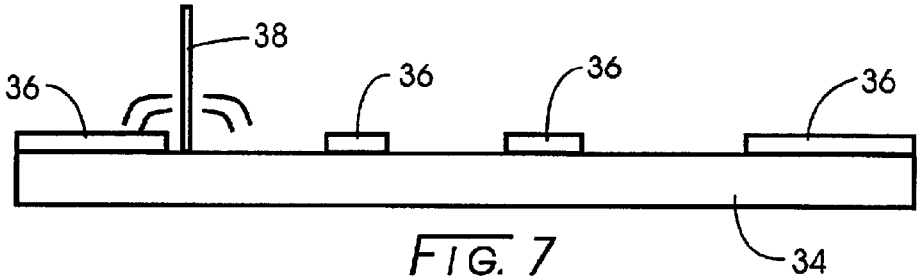

FIG. 7 illustrates the second processing step, wherein a pattern is formed on the work surface of tool core 34 by selective removal of coating 36, preferably with the aid of a laser beam, 38. While other means of removal certainly are operable (e.g., mechanical abrasion, electron beam, etc.), the use of a laser (e.g., YAG, $CO_2$, or other industrial laser) is preferred for its preciseness in forming intricate patterns in coating 36 and patterns of very small dimension. Another advantage in using a laser beam to selectively form a pattern in coating 36 is that such pattern can be formed independent of work surface geometry. That is, laser beam 38 can form a pattern at radius 12 (FIG. 3), radius 18 (FIG. 4), and ridges 24–30 (FIG. 5) with the same degree of precision as it forms a pattern in the planar work surface of tool core 34. Patterns suitable in size to accommodate single grains of abrasive are possible. Conventional computer or numerical control of laser beam 38 is easy to implement for forming precise patterns in coating 36, as those skilled in the art will appreciate.

The amount (depth) of coating 36 required for removal is sufficient so that the abrasive particles can be electroplated or electroless plated onto the work surface of tool core 34. Incomplete removal of coating 36, then, may be quite tolerable.

Figure 8:
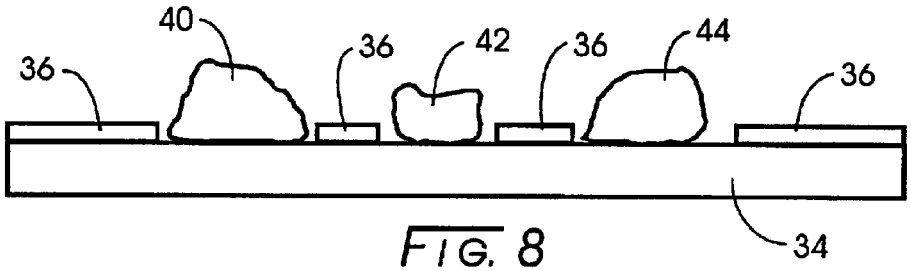

FIG. 8 illustrate the electroplating of abrasive particles, 40–44, onto tool core 34 in the patterned areas whereat coating 36 has been removed and/or reduced in thickness sufficient for galvanic plating of abrasive particles to occur. Galvanic electroplating is well known technique wherein a galvanic bath of galvanic liquid, metal anode, and abrasive particles is formed. The workpiece (e.g., tool core 34) serves as the cathode. The metal anode (e.g., Ni) is dissolved into a plating bath. The corresponding metal cations then are plated onto the exposed surfaces of the tool core 34 and attach the abrasive particles that are in direct contact with the tool core, building up a defined metal layer (e.g., Ni). For workpieces that are not electrically conductive, conductive coatings can be applied to the surfaces to be electrocoaeted or electroless coated, as is well known in the art. General electroplating conditions are documented by Robert Brugger in *Nickel Plating a Comprehensive Review of Theory, Practice and Applications Including Cobalt Plating*", Robert Draper Ltd. Teddington (1970).

By employing this plating technique to plate abrasive particles onto the exposed, patterned areas of the work surface of tool core 34, the number of single layer particles of abrasive can be determined. That is, if the patterned area is small enough to accommodate only a single crystal of abrasive, then a single crystal of abrasive can be electroplated or electroless plated. This is applicable to any given tool geometry. In fact, the foregoing process steps can be executed multiple times. Areas already electroplated or electroless plated with abrasive crystals and metal can be coated and other areas etched by laser beam 38. Areas already electroplated or electroless plated with abrasive crystals and metal can be coated more than once. In each of these iterative process steps, the abrasive crystals can be varied by size, type or quality, concentration, etc.

Figure 9:
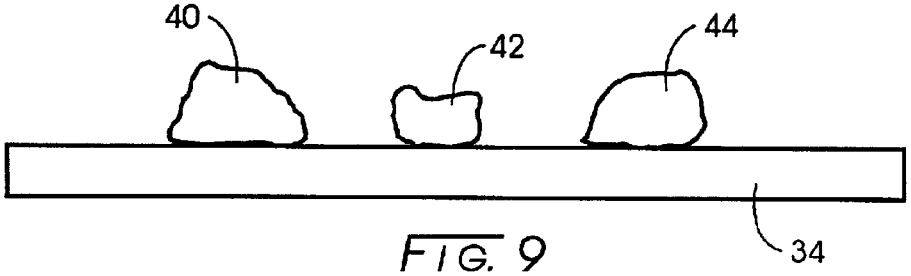

As a final step, FIG. 9 illustrates the removal of the remaining areas of coating 36. This coating removal step is performed for cosmetic reasons or for a second plating step to further embed the crystal to a specific level; although, the presence of coating may interfere with the performance of tool core 34 on occasion. Chemical dissolution of coating 36 most often is the practiced as a removal process of the present invention.

Figure 10:
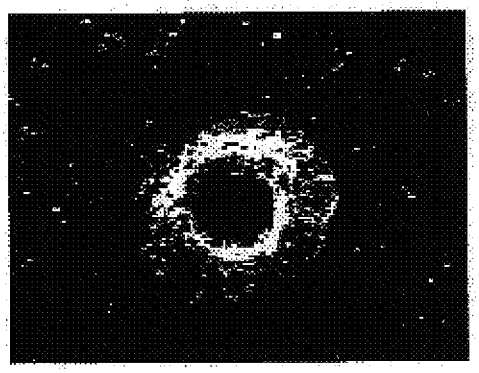
FIG. 10 is a photomicrograph (200 × magnification) showing the work surface of a coated tool that has an area of paint removed by laser beam treatment.
Figure 11:
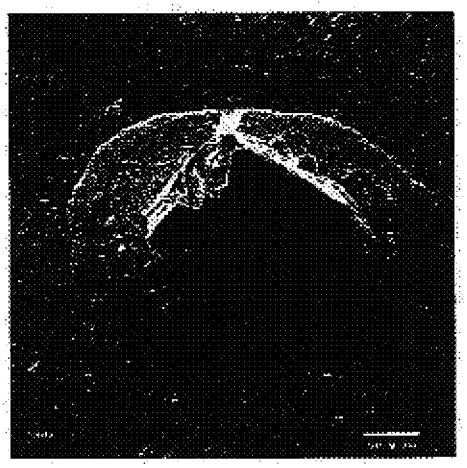
FIG. 11 is a photomicrograph (300 × magnification) showing a single abrasive crystal that has been plated onto the tool work surface at the laser beam treatment location.
Figure 12:
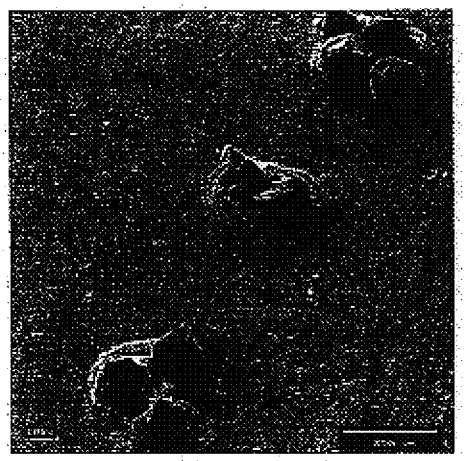
FIG. 12 is a photomicrograph (100 × magnification) showing 3 pockets or clusters or an precisely controlled array of a defined number of abrasive crystals are seen plated onto the tool work surface.

FIG. 10 is a photomicrograph (200× magnification) showing the work surface of a coated tool that has an area of paint removed by laser beam treatment. The disruption on the integrity of the coating is evident. FIG. 11 is a photomicrograph (300 × magnification) showing an abrasive crystal that has been plated onto the tool work surface at the laser beam treatment location. The abrasive crystal has been precisely deposited at the intended location. This is even more evident in FIG. 12 (100× magnification), where 3 pockets or clusters or a precisely controlled array of abrasive crystals are seen plated onto the tool work surface.

Figure 13:
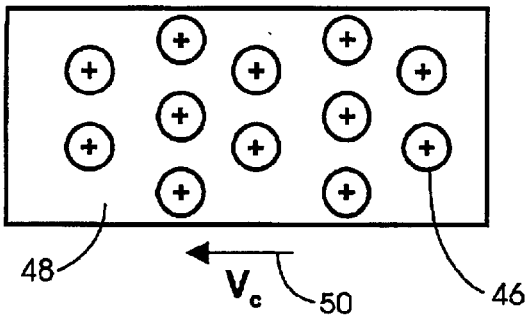
FIG. 13 is an overhead plan schematic representation of a tool having an orderly array of abrasive particles that have been deposited in accordance with the present invention.

Such precisely controlled array of abrasive crystals has many benefits. This is evident by reference to FIG. 13, which is an overhead plan schematic representation of a tool having a precisely order array of abrasive particles that have been deposited in accordance with the present invention. Each abrasive crystal or cluster of crystals, e.g., representative crystal 46, is located in an orderly array determined before galvanic plating of the crystals onto the work surface of the tool, 48.

Figure 14:
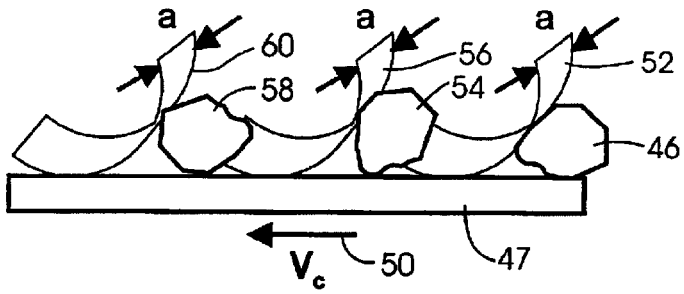
FIG. 14 is a side elevational schematic representation of a tool removing fairly equal sized chips from a workpiece because of the use of a wheel having an orderly array of abrasive particles.

In use, tool 48 is moved in the direction indicated by arrow 50 at a velocity, $V_c$. FIG. 14 is a side elevational schematic representation of tool 48 moving in the direction of arrow 50 and a rate of $V_c$. Representative abrasive crystal 46 is seen removing a chip, 52; an abrasive crystal, 54, is seen removing a chip, 56; and an abrasive crystal, 58, is seen removing a chip, 60. Now, because each abrasive crystal 46, 54, and 58 is uniformly spaced apart on the work surface of tool 48, the average thickness, a, of chips 52, 56, and 60 should be approximately the same and improved cutting performance is expected compared to state of the art using plated grinding tools.

Figure 15:
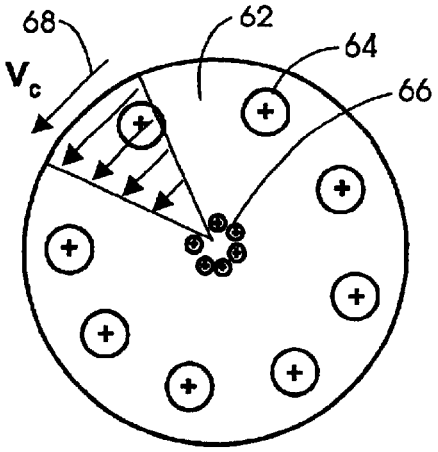
FIG. 15 is an overhead plan schematic representation of a wheel having an orderly array of abrasive particles that have been deposited in accordance with the present invention and depicting the relationship between radial wheel speed and chip thickness.

FIG. 15 is an overhead plan schematic representation of a wheel, 62, having an orderly array of abrasive particles, e.g., crystals 64 and 66, deposited in accordance with the present invention. The size of crystals 64 and 66 in FIG. 15 is intended to delineate one or more of larger abrasive crystals or a higher concentration of abrasive crystals at each location. Finally, wheel 62 is moving in the direction of arrow 68 at a radial velocity, $V_c$.

Now, the following relationships hold for wheel 62 in FIG. 15:

$$V_c \uparrow \Rightarrow a \downarrow$$
$$\text{Concentration} \uparrow \Rightarrow a \downarrow$$

where a is the average chip thickness. Stated otherwise, as the radial velocity of wheel 62 increases, the thickness, a, of the chips decreases. Similarly, as the concentration (per unit area) of abrasive particles increases, the thickness, a, of the chips also decreases. Compared to grinding with conventionally plated grinding wheels, use of wheels manufactured in accordance with the present invention allows for better control of chip thickness and uniformity.

Figure 16:
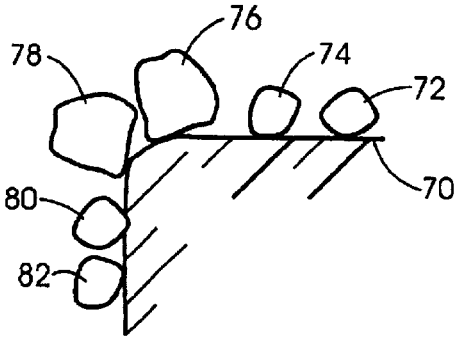
FIGS. 16 and 17 are magnified side elevational schematic representations of tools showing reinforced profile segments by size, concentration, and abrasive type.

Unique with the present invention is the ability to precisely and orderly lay out a pattern of abrasive crystals on the work surface of a tool. This can be seen by reference to FIGS. 16 and 17. In FIG. 16, a tool work surface, 70, exhibits a radiused bend about which abrasive particles, 72–82, are disposed. It will be observed that crystals 76 and 78, which are disposed at the radius or bend, are larger in size than the other crystals that are disposed on the planar areas of tool work surface 70. Obviously, the number and size of the crystals is only representative in FIG. 16, but the ability to control particle size, type, and placement is well illustrated.

Figure 17:
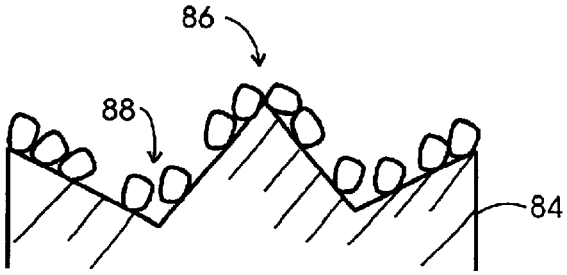

Using a two-step process, larger crystals 76 and 78 can be exactly positioned to reinforce specific area of the tool, as illustrated in FIG. 16. FIG. 17 illustrates the capability of the present invention by showing a higher density of crystals about the cutting ridges of a tool, 84. By way of illustration only, it will observed that the density of crystals group, 86, located at the ridges is higher than the density of crystal group, 88, along the planar areas.

The skilled artisan will appreciate that the same abrasive coated work surfaces can be obtained by an alternative embodiment where a designated area of the work surface (or the entire work surface) is coated with an adhesive, i.e. a material that will at least temporarily bind the abrasive particles to the work surface until metal plating occurs. Adhesives, for example, can be formulated from the same list of resins that are formulated into coatings listed above. The laser beam, for example, then would etch away the areas where no abrasive particles are desired. The desired abrasive particles then can be adhered onto the work surface by the remaining adhesive. This technique, of course, could be practiced multiple times to control the quantity, type, and size of abrasive particles that are precisely positioned onto the work surface. Metal plating would be a final step once all of the desired abrasive particles are adhered to the work surface.

Suitable abrasive particles include, inter alia, synthetic and natural diamond, cubic boron nitride (CBN), wurtzite boron nitride, silicon carbide, tungsten carbide, titanium carbide, alumina, sapphire, zirconia, combinations thereof, and like materials. Such abrasive particles may be coated with, for example, refractory metal oxides (titania, zirconia, alumina, silica) (see, e.g., U.S. Pat. Nos. 4,951,427 and 5,104,422). Processing of these coatings includes deposition of an elemental metal (Ti, Zr, Al) on the abrasive particle surface followed by oxidizing the sample at an appropriate temperature to convert the metal to an oxide. Additional coatings include refractory metals (Ti, Zr, W) and other metals (Ni, Cu, Al, Cr, Sn).

A wide variety of tools can be subjected to the invention including, for example, metal tools, vitreous bond tools, resin bond tools (phenol-formaldehyde resins, melamine or urea formaldehyde resins, epoxy resins, polyesters, polyamides, and polyimides), and the like. Tools not electrically conductive can be coated with an electrically conductive metal over the work surface to be galvanically coated with the abrasive particles. Alternatively, electrically conductive particles included in the bond (at least at the work surface) also may permit galvanic coating of nonelectrically conductive tools.

The coating for the tool work surface must withstand the rigors of the galvanic bath and handling of the tool during fabrication processing. This means that the coating or paint must be resistant to both acid and base, stable at the elevated temperatures using for galvanic plating, and sufficiently adherent to the tool work surface that the tool can be handled. Suitable such paints include, for example, epoxy resins, acrylic resins, vinyl resins, polyurethanes, amine-formaldehyde resins, amide-formaldehyde resins, phenol-formaldehyde resins, polyamide resins, waxes, silicone resins, and the like, such as disclosed above. Epoxy resins presently are preferred.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

What is claimed is:

1. A method for fabricating an abrasive tool having a work surface, which comprises the steps of:

(a) applying an electrically non-conductive layer on the work surface of an abrasive tool;

(b) etching a pattern in said work surface;

(c) plating a metal and abrasive particles onto the work surface pattern; and (d) removing said non-conductive layer from said working surface.

2. The method of claim 1, wherein said abrasive particles are one or more of synthetic diamond, natural diamond, cubic boron nitride (CBN), wurtzite boron nitride, silicon carbide, tungsten carbide, titanium carbide, alumina, sapphire, or zirconia.

3. The method of claim 2, wherein said abrasive particles are coated with one or more of a metal or metal oxide.

4. The method of claim 3, wherein said metal is one or more of Ti, Zr, Cr, Co, Si, W, Ni, Cu, or Al.

5. The method of claim 1, wherein said layer is one or more of an epoxy resin, acrylic resin, vinyl resin, polyurethane, amine-formaldehyde resin, amide-formaldehyde resin, phenol-formaldehyde resin, wax, a silicone resin, or polyamide resin.

6. The method of claim 1, wherein said pattern is etched in said work surface with one or more of a laser or an electron beam.

7. The method of claim 1, wherein said plating is conducted under one or more of electroplating or electroless metal plating conditions.

8. The method of claim 7, wherein said metal plated is one or more of Ni, Co, Sn, or Cr.

9. The method of claim 1, which is repeated one or more times.

10. The method of claim 1, wherein said abrasive tool work surface, which is electrically non-conductive, is pre-coated with an electrically conductive metal.

11. The method of claim 10, wherein the areas where abrasive particles are desired is masked prior to step (a).

12. The method of claim 1, wherein said abrasive tool is one or more of a grinding element, polishing element, cutting element, or drilling element.

13. The method of claim 9, wherein one or more of size, type, quality, or concentration, of said abrasive particles is varied during said one or more times the method is repeated.

14. The method of claim 13, wherein said abrasive particles are one or more of diamond or CBN.

15. A method for fabricating an abrasive tool having a work surface, which comprises the steps of:

(a) applying an adhesive layer on the work surface of an abrasive tool;

(b) etching a negative of a pattern in said work surface;

(c) contacting said work surface with abrasive particles to form said pattern of abrasive particles thereon; and (d) plating a metal onto said working surface.

16. The method of claim 15, wherein said abrasive particles are one or more of synthetic diamond, natural diamond, cubic boron nitride (CBN), wurtzite boron nitride, silicon carbide, tungsten carbide, titanium carbide, alumina, sapphire, or zirconia.

17. The method of claim 16, wherein said abrasive particles are coated with one or more of a metal or metal oxide.

18. The method of claim 17, wherein said metal is one or more of Ti, Zr, Cr, Co, Si, W, Ni, Cu, or Al.

19. The method of claim 15, wherein said adhesive is formulated from one or more of an epoxy resin, acrylic resin, vinyl resin, polyurethane, amine-formaldehyde resin, amide-formaldehyde resin, phenol-formaldehyde resin, wax, a silicone resin, or polyamide resin.

20. The method of claim 15, wherein said negative of said pattern is etched in said work surface with one or more of a laser or an electron beam.

21. The method of claim 15, wherein said plating is conducted under one or more of electroplating or electroless metal plating conditions.

22. The method of claim 21, wherein said metal plated is one or more of Ni, Co, Sn, or Cr.

23. The method of claim 15, which is repeated one or more times.

24. The method of claim 15, wherein said abrasive tool is one or more of a grinding element, polishing element, cutting element, or drilling element.

25. The method of claim 23, wherein one or more of size, type, quality, or concentration, of said abrasive particles is varied during said one or more times the method is repeated.

26. The method of claim 25, wherein said abrasive particles are one or more of diamond or CBN.

* * * * *